US006131509A

United States Patent [19]

Davis

[11] Patent Number: 6,131,509

[45] Date of Patent: Oct. 17, 2000

[54] METHOD AND APPARATUS FOR PERFORATING AND CRUSHING CONTAINERS

[75] Inventor: Robert M. Davis, El Cajon, Calif.

[73] Assignee: CP Manufacturing, Inc., National City, Calif.

[21] Appl. No.: 09/248,394

[22] Filed: Feb. 12, 1999

[51] Int. Cl.[7] ..... B03B 15/08; B03B 3/04; B03B 9/00

[52] U.S. Cl. ..... 100/39; 100/98 R; 100/161; 100/172; 100/176; 100/902; 225/100; 241/236

[58] Field of Search ..... 100/39, 94–98 R, 100/161, 172, 176, 902; 225/100; 241/230, 235, 236; 414/411, 412

[56] References Cited

U.S. PATENT DOCUMENTS

| | | | |
|---|---|---|---|
| 1,075,781 | 10/1913 | Goldschmidt | 100/94 |
| 3,062,460 | 11/1962 | Bunney | 241/236 |
| 3,103,163 | 9/1963 | Gates | 100/98 R |
| 3,489,354 | 1/1970 | Harper et al. | 100/176 |
| 3,643,591 | 2/1972 | Bragg | 100/176 |
| 3,749,004 | 7/1973 | Pagdin et al. | 100/94 |
| 3,951,059 | 4/1976 | Morris | 100/176 |
| 4,221,040 | 9/1980 | Good | 100/902 |
| 4,925,117 | 5/1990 | Ramos . | |
| 5,025,995 | 6/1991 | Smith | 100/902 |
| 5,092,234 | 3/1992 | Von Rohr . | |
| 5,133,124 | 7/1992 | Burroughs | 100/98 R |
| 5,192,031 | 3/1993 | Gilbert | 100/176 |
| 5,195,429 | 3/1993 | Firpo . | |
| 5,746,378 | 5/1998 | Beadle et al. | 241/236 |

FOREIGN PATENT DOCUMENTS

| | | | |
|---|---|---|---|
| 463676 | 5/1951 | Italy | 100/172 |
| 112842 | 1/1918 | United Kingdom | 100/98 R |

*Primary Examiner*—Stephen F. Gerrity
*Attorney, Agent, or Firm*—Gray Cary Ware Freidenrich

[57] ABSTRACT

An apparatus and method of use is disclosed for a machine used for perforating and flattening or crushing containers of varying sizes and materials. The disclosed machine has a frame having an input opening and a discharge opening. A first plurality of shafts and second plurality of shafts are rotatably supported by the firame. The first plurality of shafts are disposed in a first plane and the second plurality of shafts are disposed in a second plane. The second plane is acutely angled with respect to the first plane. One or more motors rotate the first and second plurality of shafts, each shaft having perforating elements positioned along them. The perforating elements are offset between adjacent performing shafts such that adjacent perforating elements overlap but do not touch the adjacent shaft. The perforating elements have a plurality of spikes capable of perforating the container being perforated and crushed. In use, containers are introduced into the frame through the input opening. The containers enter and engage the first plurality of shafts and the second plurality of shafts disposed on intersecting planes. As the containers travel between the first and second plurality of shafts, the area between the first and second plurality of shafts becomes progressively smaller and closes in on the containers, crushing them between shafts of the first and second plurality of shafts with the spikes puncturing the containers, relieving them of any pressure or contents. After flattening or crushing, the containers are discarded through the discharge opening. In another embodiment, a pair of rotatable crushing members are located near the intersecting planes, further crushing the containers as they exit the first and second plurality of shafts.

22 Claims, 9 Drawing Sheets

METHOD AND APPARATUS FOR PERFORATING AND CRUSHING CONTAINERS

BACKGROUND OF THE INVENTION

The present invention relates to a machine used for processing recyclable materials, and more particularly, to a machine for crushing containers of varying sizes and materials, while also relieving any internal pressure or contents inside the containers.

Material recycling has become an important industry in recent years due to decreasing landfill capacity, environmental concerns and the dwindling of natural resources. Many industries and communities have adopted voluntary and mandatory recycling programs for reusable materials. One problem facing these programs is the huge volume of containers that are generated. Once used, recyclable container, should ideally be crushed (flattened or compacted) for economical transportation of the spent containers to a landfill, recycling center or factory. Ideally the contents of the containers are removed before the container is crushed.

When collected for processing, the containers may still contain materials such as liquid, sand, or dirt or they may be filled with air. Crushers and compactors have been developed whose primary purpose is to crush cans and beverage containers. One method of crushing employs a linear action that compresses the container. A major concern with these crushers is that if the containers are sealed with contents still inside, pressure may build during the crushing cycle, which if not relieved, may cause the containers to explode, damaging the machine or, worse, injuring the machine operator. Other types of crushers have been developed that crush the container between a pair of rotating wheels or between a rotating wheel and a wall.

In addition to the concerns of relieving the pressure and removing the contents, the prior art crushers machines are generally designed to crush a specific container, such as an aluminum can or small beverage container. Manifestly, it is not practical to provide a recycling operation with a unique crusher for each type of container.

Therefore, what is needed is an effective, inexpensive means for crushing containers of varying sizes, shapes and materials that also allows their contents to escape before the containers are completely crushed. All of this should be done with a machine that is reliable and easy to operate.

SUMMARY OF THE INVENTION

This invention is a machine that crushes (or flattens or compacts) containers of various sizes and shapes that are made from materials such as plastic, aluminum and metal. The machine includes a frame in which are disposed a plurality of rotatable shafts that are rotatably supported by the frame and powered by a motor. The frame has an input opening for receiving the containers to be crushed, and a discharge opening through which the crushed containers exit the machine. The input opening is located near a top front portion of the frame, and the discharge opening is located near a rear portion of the frame.

Rotatable shafts are mounted inside the frame. The shafts are rotatably supported by sides of the frame. A plurality of first shafts are disposed in a first horizontal plane along a first portion of the frame, while a plurality of second shafts are disposed in second plane in a second portion of the enclosure. The second plane is acutely angled with respect to the first plane. The first and second planes intersect near the second end of the frame.

A plurality of perforating elements are located on shafts of the first and second pluralities of shafts. A perforating element may include a plurality of spikes capable of perforating containers that are to be processed. In an illustrative embodiment, the perforating elements are mounted along the rotatable shafts with generally equal spacing between them. Perforating elements on adjacent shafts may be offset such that the perforating elements on one shaft fit between the perforating elements on an adjacent shaft.

In another illustrative embodiment, a pair of crushing members are positioned near the intersection of the first and second planes to accept containers after they have passed between the first and second pluralities of shafts and crush it further.

A pair of motors are mounted on the frame for rotating the plurality of shafts. Through a series of drive wheels and drive belts, a first motor rotates the first plurality of shafts in a first direction while a second motor rotates the second plurality of shafts in a second direction, the second direction being opposite the first direction.

In use, the motors rotate the shafts in the opposing directions. Containers are fed into the machine through the input opening and land on the perforating elements of the first shafts, which transport the containers toward the discharge opening. Due to the angled plane in which the second shafts lie, as the containers approach the discharge opening, they are transported through a space between the planes that becomes progressively smaller and closes in on the containers, crushing them between shafts of the first and second pluralities of shafts. At the same time, the perforating elements pierce the containers, permitting any contents to flow out. The containers continue to travel between the first and second shafts eventually emerging through the discharge opening. The crushed containers may then be fed or put onto a conveyer or any other suitable means of carrying for transport to a processing area.

These and other objects, advantages, features, and functions of the invention will become apparent from the following detailed description when read in conjunction with the below-described drawings.

DETAILED DESCRIPTION OF THE PREFERRED EMBODIMENT

Figure 1:
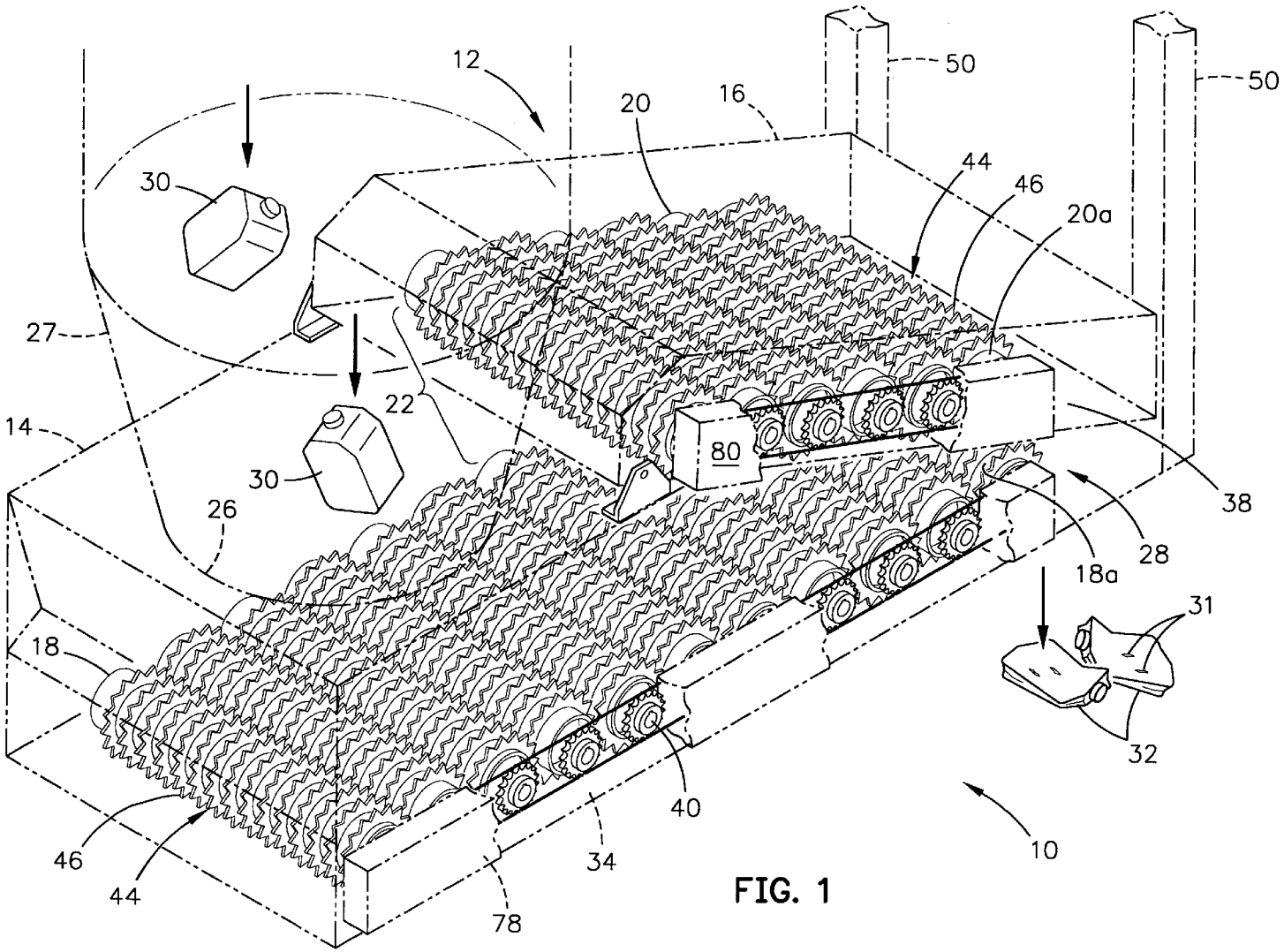
FIG. 1 is a perspective view of a crushing machine that embodies an illustrative example of the invention, with portions cut away to show internal details.

My invention is a machine that crushes containers, of various sizes and made of materials such as plastic, aluminum or metal. Refer to FIGS. 1–5, which illustrate the invention in one embodiment. The machine, indicated generally by 10, includes a frame (or housing) 12, having a first portion 14 in which a first plurality of rotatable shafts 18 ("first rotatable shafts") are positioned, and a second portion 16 in which a second plurality of rotatable shafts ("second rotatable shafts") 20 are positioned. A first motor 22 mounted on the fame 12 is coupled to a drive chain 24 that imparts a rotational force to the first rotatable shafts 18, while a second motor 23 also mounted on the frame 12 is coupled to a drive chain 25 that imparts a rotational force to the second rotatable shafts 20.

Figure 2:
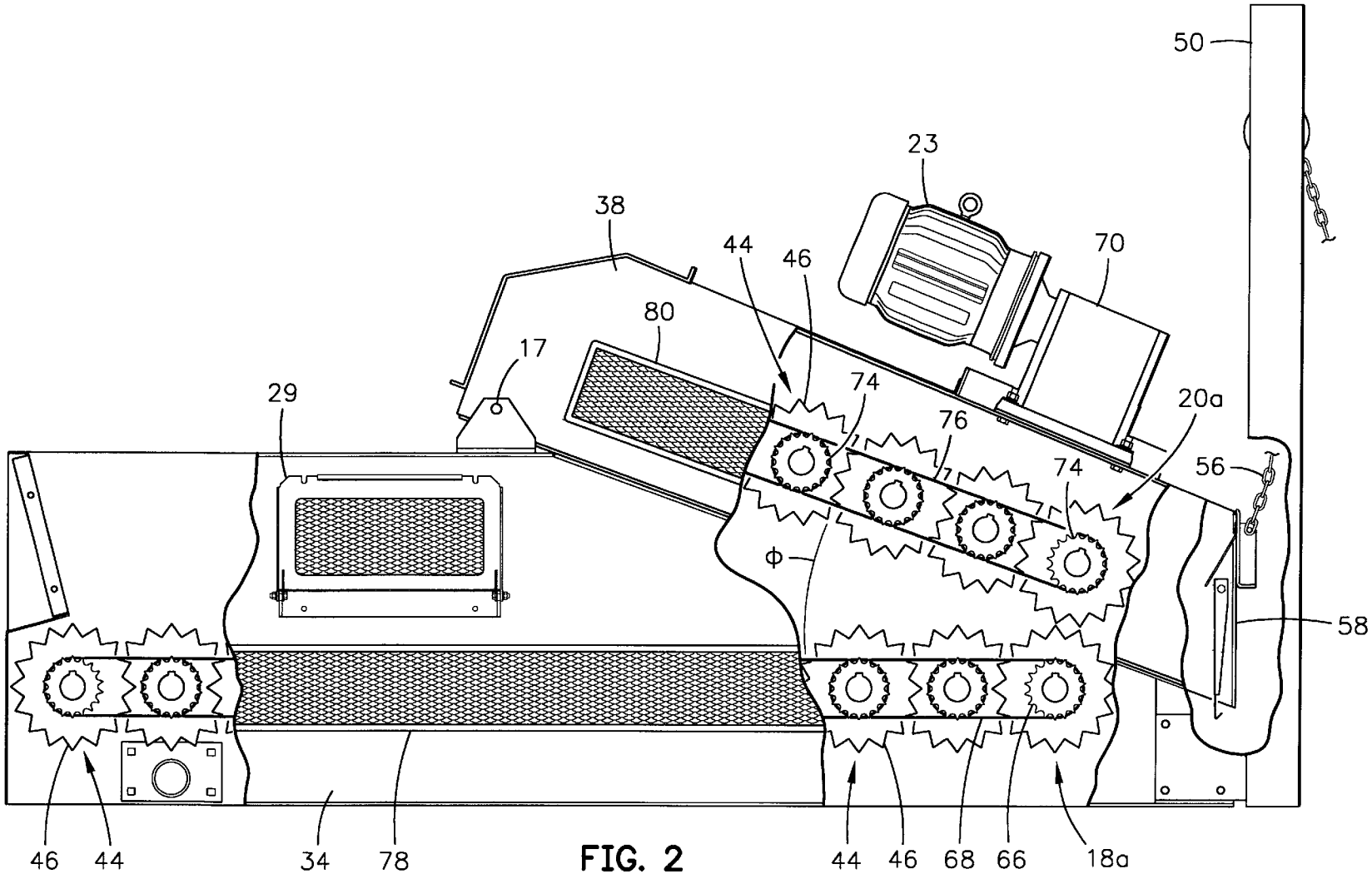
FIG. 2 is a side elevation view of the machine of FIG. 1.
Figure 3:
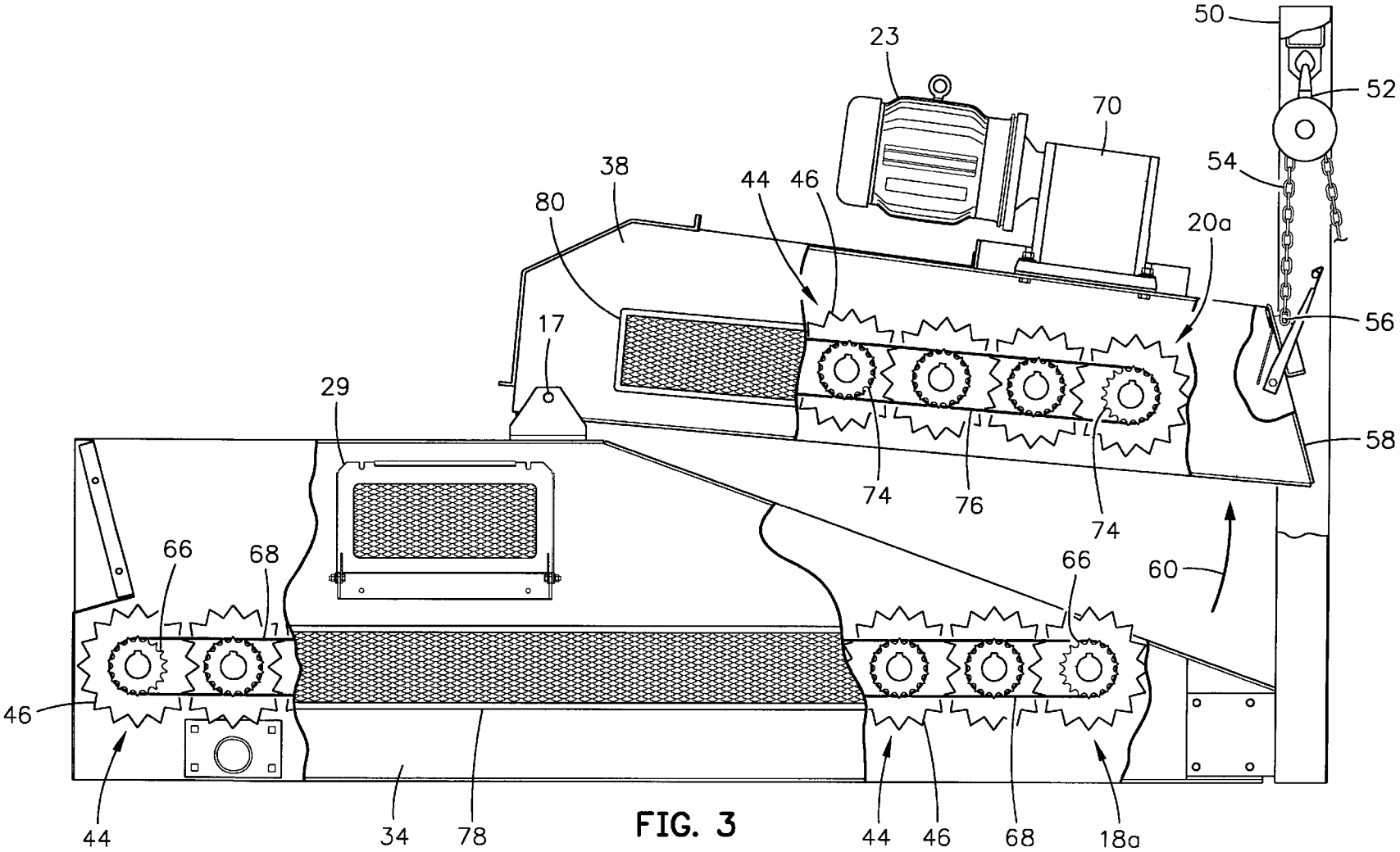
FIG. 3 is similar to FIG. 2, with a second portion rotated up away from a first portion.

In the preferred embodiment, the frame 12 is constructed using durable, heavy duty materials, such as steel. The precise shape of the frame 12, and its structure and layout, are subject to the design considerations and operational constraints of any particular application. However, in this example the frame 12 is a generally closed structure with an input opening 26 and discharge opening 28. The second portion 16 of the frame is hinged at 17 to allow rotation of the second portion 20 toward and away from the first portion 14 and access to the inside of the frame. Referring to FIGS. 2 and 3, the machine 10 is shown with the second portion 16 in place (FIG. 2) and rotated away from the first portion 14. Near the rear of the frame 12 is a support frame 50 with a raising mechanism, in this case a ½ ton chain hoist 52. To rotate the second portion 16, a chain 54 on the hoist is attached at 56 near an end 58 of the second portion 16 opposite the hinge 17. As the chain 54 lifts the end 58, the second portion 16 rotates, as shown by the arrow 60. A locking mechanism may be employed to prevent unwanted rotation of the second portion 16. Access doors 29 may be provided in frame 12 allowing access into the interior of the frame 12. Although the frame 12 forms an enclosure, this is not absolutely necessary to the invention, but it may be required for safety reasons. The input opening 26 is generally located in the top of the structure, near the front of the frame 12, where the containers 30 enter the machine. An input hopper 27 may also be used to funnel the containers 30 though the input opening 26. The container discharge opening 28 is generally located near the rear of the frame 12 where the crushed containers 32 are discharged from the machine 10.

Internal to the machine 10 are the first and second rotatable shafts 18 and 20. The first rotatable shafts 18 extend through and are supported between sides 34 and 36 of the first portion 14 while the second rotatable shafts 20 extend through and are supported between sides 38 and 40 of the second portion 20. The first rotatable shafts 18 are located in a first plane and the second rotatable shafts 20 are located in a second plane. The first and second planes are so disposed with each other to form an acutely-angled, wedge-shaped space. In the preferred embodiment shown in the figures, the first plane is generally disposed horizontally in the first portion 14 but is not limited to horizontal and may vary between horixontal and verticle. The second plane positioned the second portion 16 at an angle such that its projection intersects the first plane near the end of the frame 12. The size of the opening 22 between the first portion 14 and second portion 16 is dependent on the size of containers or material stream to be crushed and the number of rotatable shafts. The opening 22 should be large enough to allow entry of the containers between the first shafts 18 and the second shafts 20.

The number of shafts is dependent on the size of the machine 10 and on intershaft spacing. In the preferred embodiment, the number of shafts in the first plurality of shafts 18 is greater than the number of shafts in the second plurality of shafts 20 to allow containers dropped from above the plane in which the first shafts are disposed to land on the first plurality of shafts 18 and be conveyered by them into the opening 22 between the first shafts 18 and the second shafts 20. In the figures, there are eleven first shafts 18 and six second shafts 20. The first shafts 18 and second shafts 20 are supported by bushings or bearings 42 positioned along sides 34, 36, 38 and 40.

Figure 5:
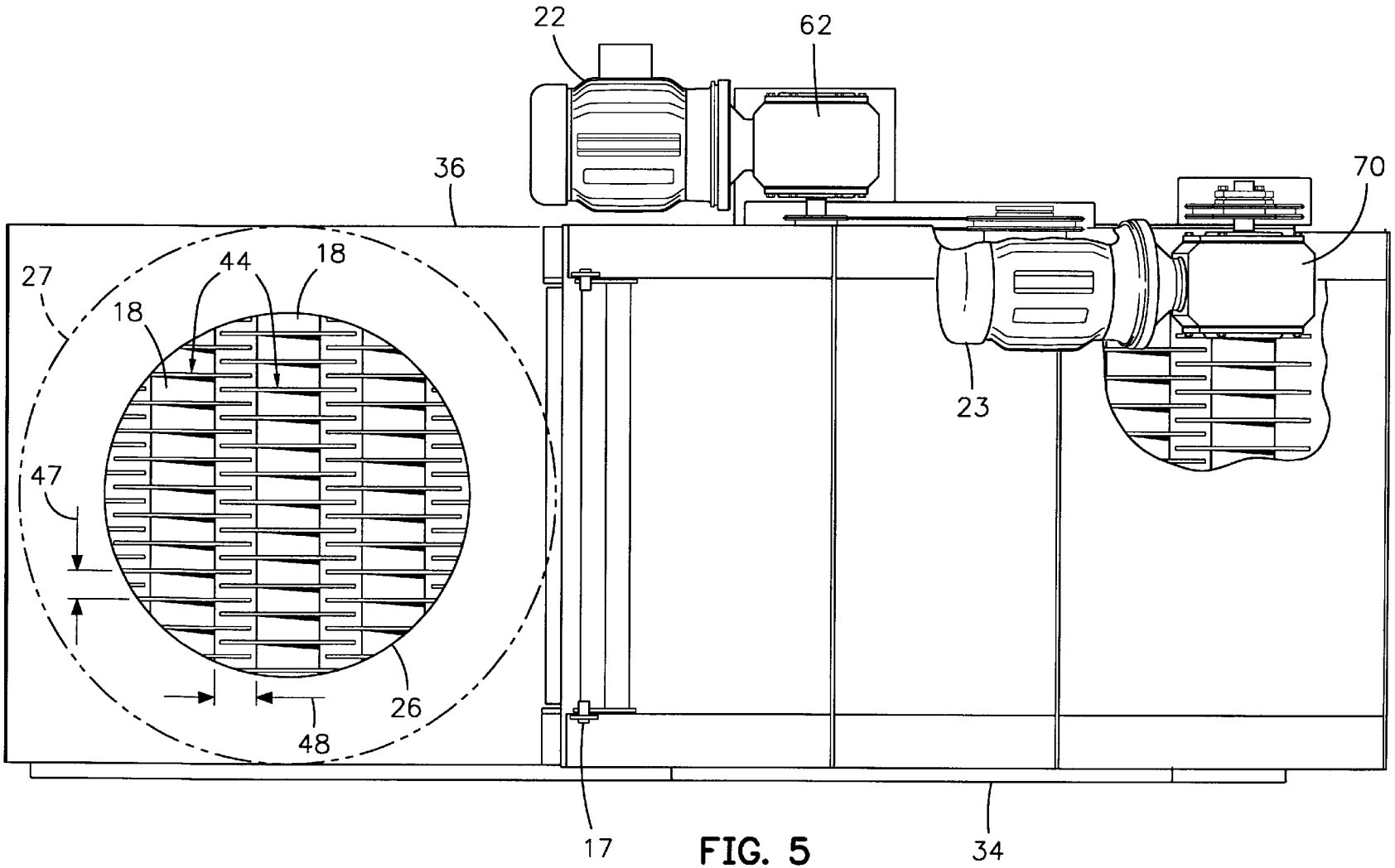
FIG. 5 is a top plan view of the machine in FIG. 1.

A plurality of perforating elements 44 made from a hard durable material, such as steel, are mounted on the first shafts 18 and the second shafts 20 by brazing, welding, or any other mode of attachment. In the illustrative example, the perforating elements 44 include spikes 46. As best seen in FIGS. 1 and 5, the perforating elements 44 are mounted along the first shafts 18 and second shafts 20 with generally equal spacing between them. The perforating elements 44 on adjacent shafts have the same equal spacing but are offset such that the perforating elements 44 on adjacent shafts fit between each other without touching the adjacent shaft. This is best viewed in FIG. 5. The spacing 47 of the perforating elements 44 and the distance 48 between adjacent shafts should be close enough such that a container 30 is able to ride along the tops of the perforating elements 44 in a screen-type fashion.

Near the intersection of the of the first and second planes is where a first shaft 18*a* is closest to a second shaft 20*a*. At this location, the spacing between the first shafts 18 and the second shafts 20 is such that a container is perforated and maximally crushed or flattened before exiting the machine 10. In the preferred embodiment, the perforating members 44 on the first shafts 18 and those on the second shafts 20 are interleaved such that the spikes 46 on the second shaft 20*a* that is nearest the discharge opening overlap the spikes 46 on the adjacent first shaft 18*a* by ½ inch. This overlap distance may be changed by rotating the second portion 16 away from the first portion 14, as discussed above and shown in FIG. 3.

Figure 4:
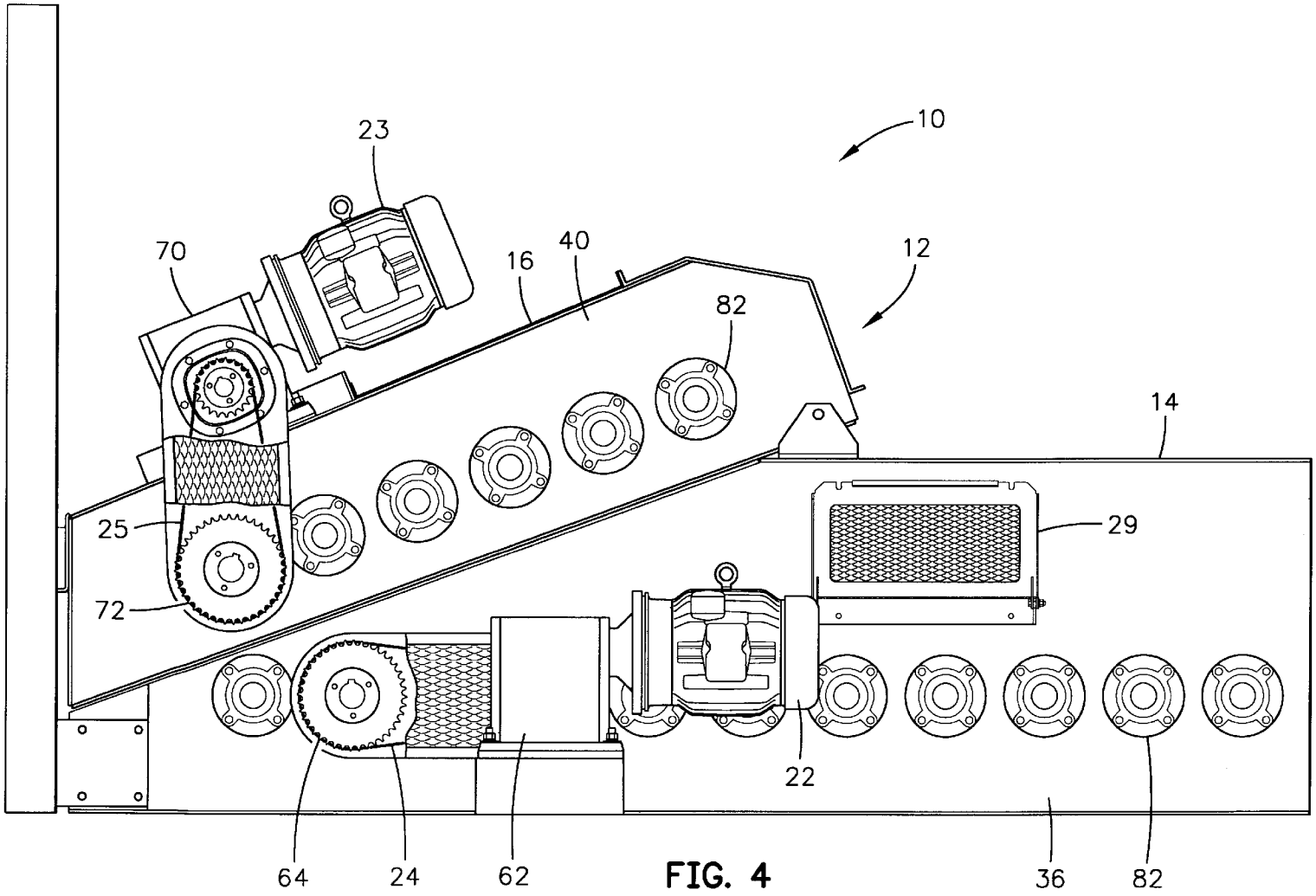
FIG. 4 is a side elevation view opposite FIG. 2.

Referring to FIGS. 4 and 5, in the preferred embodiment, the first motor 22 is positioned on the side 36 of the first portion 14 and is attached to a motor housing 62. The motor housing 62 is mounted to the first portion 14 and provides support for the first motor 22. A drive chain 24 attaches between the motor housing 62 and a drive sprocket 64 mounted on the end of the first shaft 18*a* that is on the side of 36. A plurality of rotation sprockets 66 are mounted at the end of each first shaft 18, that is on the side 34. A rotation chain 68 interconnects the plurality of rotation sprockets 66, as shown in FIG. 2. The second motor 23 is positioned on the side 40 of the second portion 16 and is attached to a motor housing 70. The motor housing 70 is mounted to the second portion 16 and provides support for the motor 23. A drive belt 25 attaches between the motor housing 70 and a drive sprocket 72 on the end of the second shaft 20*a* that is on the side 40. A plurality of rotation sprockets 74 are located at the end of each second shaft 16 on side 38. A rotation chain 76 interconnects the plurality of rotation sprockets 74, as shown in FIG. 2. A safety cover 78 on side 34 covers the plurality of rotation sprockets 66 and rotation chain 68 while a safety cover 80 on side 38 covers the plurality of rotation sprockets 74 and rotation chain 76. On sides 36 and 40, a plurality of end covers 82 cover the ends of the first shafts 18 and the second shafts 20.

The first motor 22 drives a drive sprocket in the motor housing 62, turning the drive chain 24 and drive sprocket 64, thereby rotating the first shaft 18*a* in a first direction. Since all of the first shafts 18 are interconnected by rotation sprockets 66 and rotation chain 68, all of the first shafts 18 rotate together in the first direction at the same speed. The second motor 23 drives a drive sprocket in the motor housing 70, turning the drive chain 25 and drive sprocket 72, thereby rotating the second shaft 20*a* in a second direction. Since all of the second shafts 20 are interconnected by rotation sprockets 74 and rotation chain 76, all the second shafts 20 rotate together in the second direction at the same speed. The rotating second direction of the plurality of the second shafts 20 is opposite to the rotating first direction of the plurality of first shafts 18. While each motor may rotate its plurality of shafts at a particular speed, in the illustrative embodiment, the rotation speed of the first shafts 18 is the same as the rotation speed of the second shafts 20. Although the preferred embodiment couples the motors to the shafts by sprocket/chain drives, other couplings may be used including, but not limited to, transmission couplings, geared couplings, direct couplings, and so on. Alternatively, separate individual shafts may be powered by separate individual motors. Further, the motors may be stationed at positions other than those shown, both on and off the frame 12 as design and installation considerations dictate. The sizes of the motors are dependent on a number of factors such as type of containers to be crushed, number of rollers, type of drive mechanism, and so on. For example, each may have a rating of around 3 HP, with a 90 degree worm drive.

In use, empty containers 30 are introduced into the machine 10 through the input opening 26 in the top of frame 12. The input hopper 27 may also be used to funnel the containers 30 into and through the input opening 26. Although the input hopper is directly on top of the frame 12 near its front end, this is not intended to so limit the introduction of containers into the frame 12. Indeed, if design or installation considerations dictate, an input hopper may be provided on the front end or sides of the frame 12. The containers 30 may also be input through access doors 29 in the sides of the frame 12.

Once the containers 30 are input into the frame 12, they are conveyed in a screen fashion on top of the perforating elements 44 of the first shafts 18 toward the discharge opening 28 of the frame 12. The first shafts 18 are rotated by the motor 22 to transport the containers 30 from the front to the back of the frame, as described above. Due to the angled, intersecting plane in which the plurality of second shafts 20 lie, as the containers 30 approach the rear of the frame 12, they become engaged with the perforating elements 44 of the second shafts 20. The second shafts 20 are rotating in a opposite direction from the first shafts 18, moving the containers 30 from the wide end of the wedge described by the first shafts 18 and the second shafts 20, to its narrow end. Because of the converging planes and rotation of the first shafts 18 and second shafts 20, the containers 30 start to become compressed between the first shafts 18 and the second shafts 20. As the compression starts, spikes 46 in the perforating elements 44 poke holes 31 in the containers 30, relieving them of any pressure or contents that may be inside. Due to the perforating of the containers 30 by the spikes 46, it is unnecessary to remove any caps or to fully empty the containers 30. The containers 30 continue to be crushed or flattened and perforated with holes 31 as they travel between the first shafts 18 and the second shaft 20, becoming crushed or flattened containers 32. The crushed containers 32 are then discharged through the discharge opening 28 near the end of the frame 12. Due the fact that different containers crush or flatten differently, the discharge opening 28 between the first shaft 18*a* and second shaft 20*a* may be adjusted by rotating the second portion 16 toward or away from the first portion 14, changing the distance between the first shaft 18*a* and the second shafts 20*a*. Because of the holes 31 made in the container 30 during compression, there is no danger of explosion of the containers 30 due to compression while being crushed. Optionally, the discharge opening 28 may discharge in the crushed containers 32 onto a conveyer belt, into a basket, or other suitable means of carrying the crushed containers away from the machine 10 to be further processed Refer to FIGS. 6–9 which illustrate another machine that embodies the invention. The machine, indicated generally by 100, includes an frame (or housing) 112 in which a first plurality of rotatable shafts ("first rotatable shafts") 114 and a second plurality of rotatable shafts ("second rotatable shafts") 116 and rotatable crushing members 118 and 120 are rotatably supported by the frame 112 and powered by a motor 122. The motor 122 is coupled to a drive chain 124 that imparts a rotational force to the first rotatable shafts 114 and second rotatable shafts 116 and rotatable crushing members 118 and 120.

The frame 112 is constructed using durable, heavy duty materials, such as steel. The precise shape of the frame 112, and its structure and layout, are subject to the design consideration and operational constraints of any particular application. However, in this example the frame 112 is a generally closed structure with an input opening 126 and discharge opening 128. Optionally, access doors 129 may be provided in frame 112 allowing access into the interior of the frame. The input opening 126 is generally located in the top of the structure near the front of the frame 112 where the empty containers 130 enter the machine. An input hopper 127 may also be used to fimnel the containers 130 through the input opening 126. The discharge opening 128 is generally located in the bottom of the structure near the rear of the frame 112 where the crushed containers 132 are discharged from the machine 100.

Internal to the machine 100 are the first and second rotatable shafts 114 and 116 and rotatable crushing members 118 and 120. The first rotatable shafts 114 and the second rotatable shafts 116 and rotatable crushing members 118 and 120 extend through and are supported between sides 134 and 136 of the frame 112. The first rotatable shafts 114 are located in a first plane. The second rotatable shafts 116 are located in a second plane. The first and second planes are so disposed with each other to form an acutely-angled, wedge-shaped space. The size of the opening 117 between the first plane and second plane is dependent on the size of containers to be crushed and the number of rotatable shafts.

The number of shafts is dependent on the size of the machine 100 and on intershaft spacing. In this embodiment, the number of shafts in the first rotatable shafts 114 is greater than the number shafts in the second rotatable shafts 116 to allow containers dropped from above the plane in which the first shafts are disposed to land on the first rotatable shafts 114 and be conveyered by them into the opening 117 between the first rotatable shafts 114 and second rotatable shafts 116. In the figures there are twelve first rotatable shafts 114 and six second rotatable shafts 116. The first rotatable shafts 114 and the second rotatable shafts 116 and the rotatable crushing members 118 and 120 are supported by bushings or bearings 138 positioned along sides 134 and 136.

Figure 6:
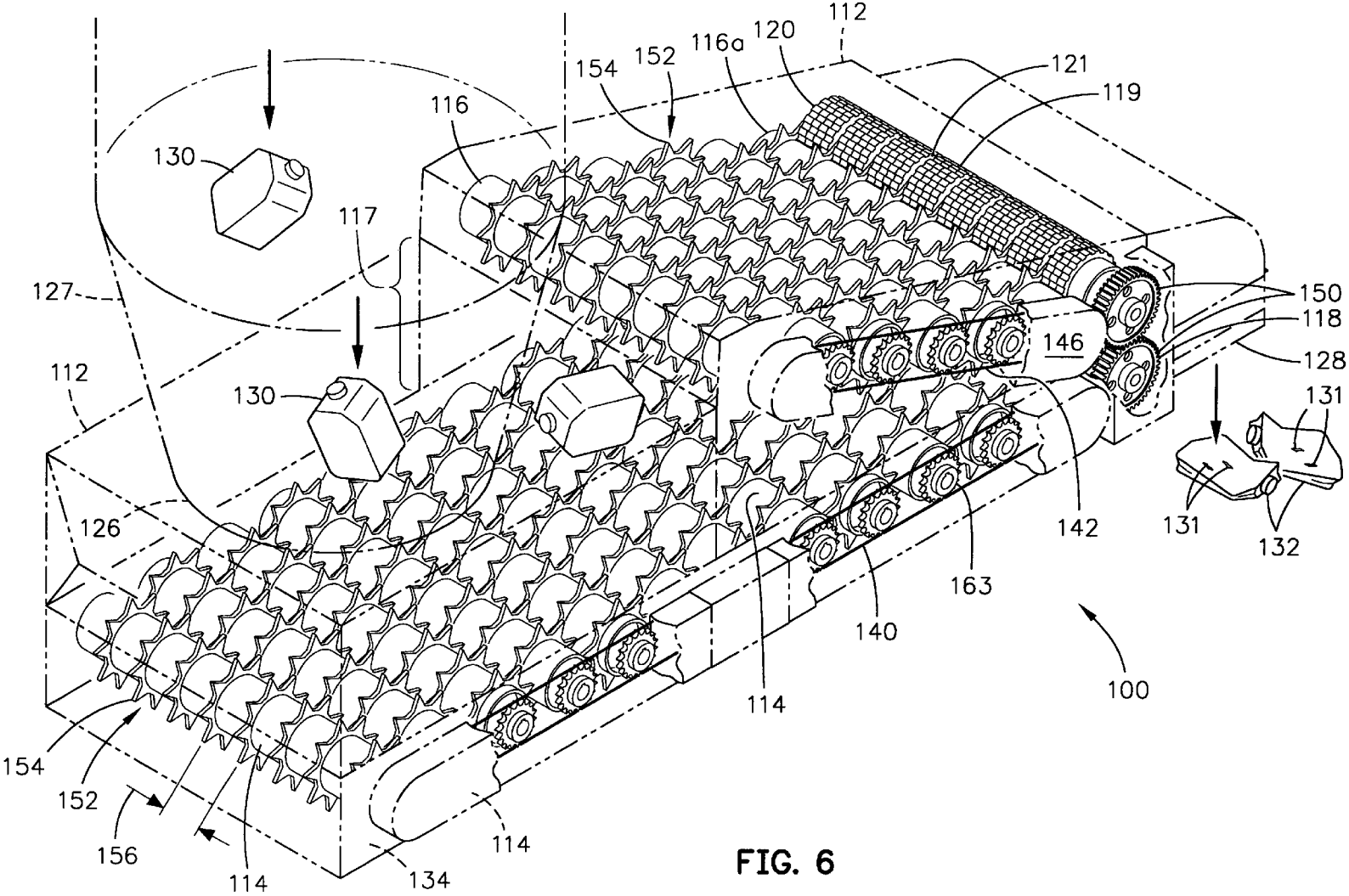
FIG. 6 is a perspective view of another crushing machine that embodies another illustrative example of the invention, with portions cut away to show internal details.
Figure 7:
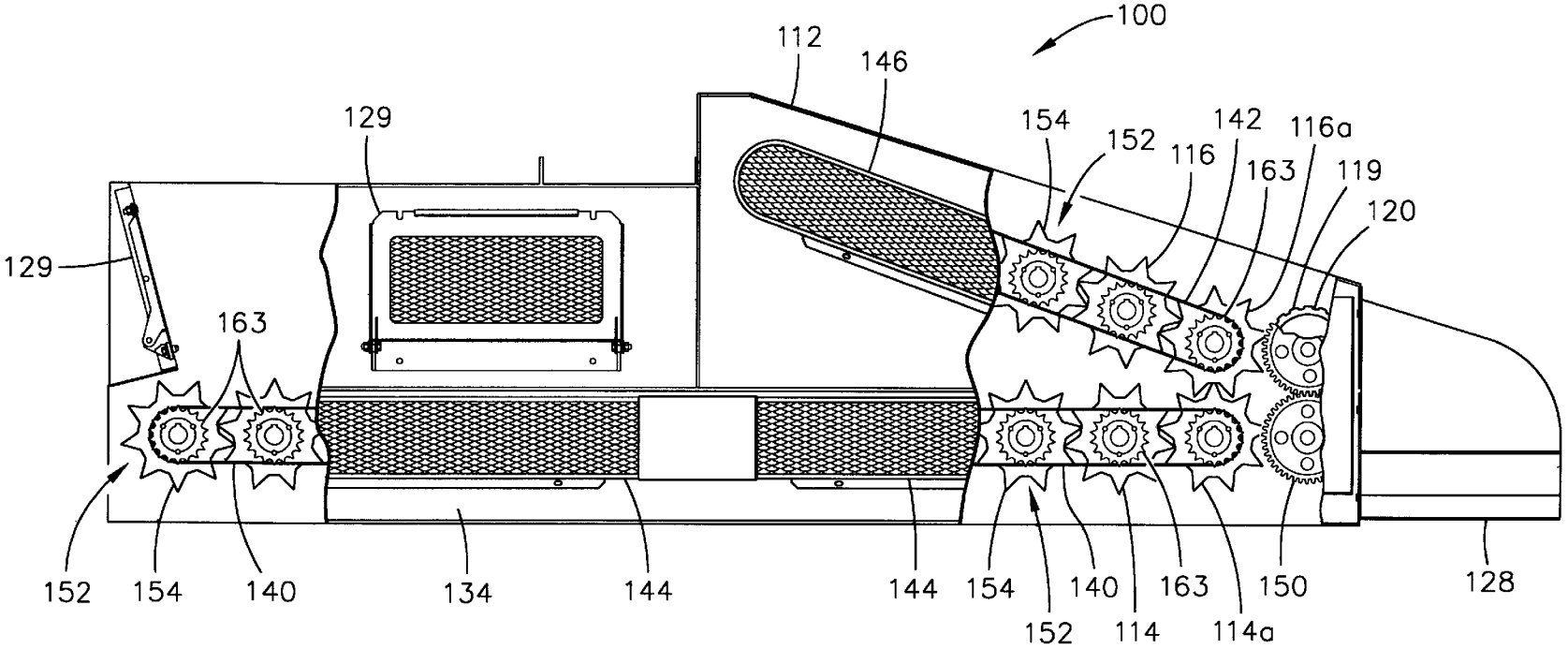
FIG. 7 is a first side elevation view of the machine of FIG. 6.
Figure 9:
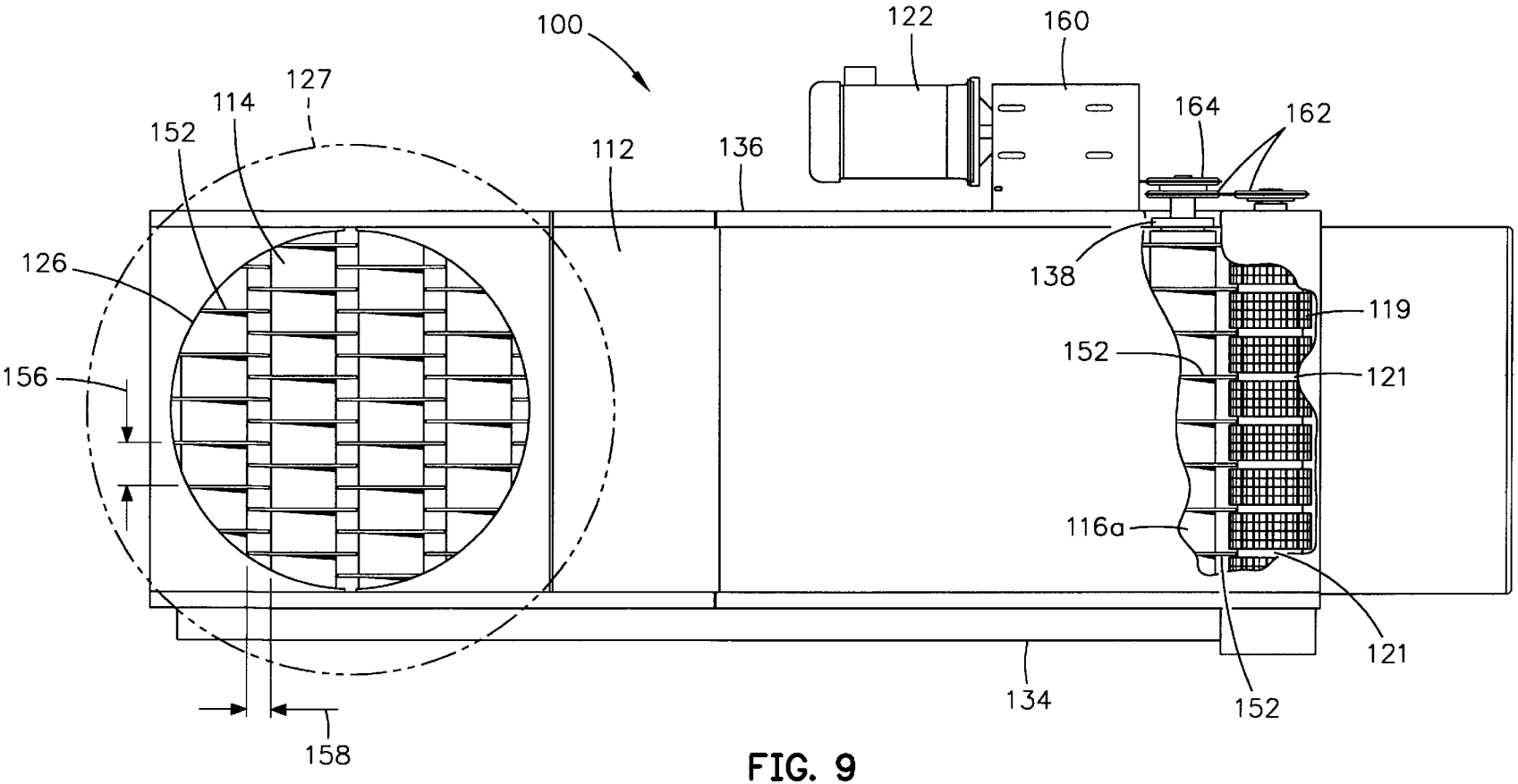
FIG. 9 is a top plan view of the machine in FIG. 6.

A plurality of perforating elements 152 made from a hard durable material, such as steel, are mounted on the first rotatable shafts 114 and the second rotatable shafts 116 by brazing, welding, or any other mode of attachment. The perforating elements 52 may include spikes 154. As best seen in FIGS. 6 and 9, the perforating elements 152 are mounted along the first rotatable shafts 114 and the second rotatable shafts 116 with generally equal spacing 156 between them. The perforating elements 152 on adjacent shafts have the same equal spacing 156, but are offset such that the perforating elements 152 on adjacent shafts fit between each other without touching the adjacent shafts. This is best viewed in FIG. 9. The spacing 156 of the perforating elements 152 and the distance 158 between adjacent shafts should be close enough such that a container is able to ride along the tops of the perforating elements 152 in a screen-type fashion toward the rotatable crushing elements 118 and 120.

Near the intersection of the first and second planes are the first rotatable crushing member 118 and the second rotatable crushing member 120. The rotatable crushing members 118 and 120 are made of strong material, such as steel and in the illustrative example, are tubular in shape. The rotatable crushing members 118 and 120 are positioned to accept the container 130 after it has been flattened or compressed and perforated by the first rotatable shafts 114 and the second rotatable shafts 116. A plurality of bumps 119 are located on the surface of the rotatable crushing members 118 and 120 to assist in crushing the container 130. The bumps 119 are aligned and spaced apart so that the separation of the bumps on adjacent crushing members determine the amount of flattening or crushing of the container 130. Additionally, a plurality of grooves 121 are located in each rotatable crushing member 118 and 120. The grooves 121 are sized to receive the perforating elements 152 of either adjacent rotatable shaft 114*a* or 116*a* without interfering with their operation. This allows the rotatable crushing members 118 and 120 to be as close as possible to the adjacent rotatable shafts 114*a* or 116*a*.

Figure 8:
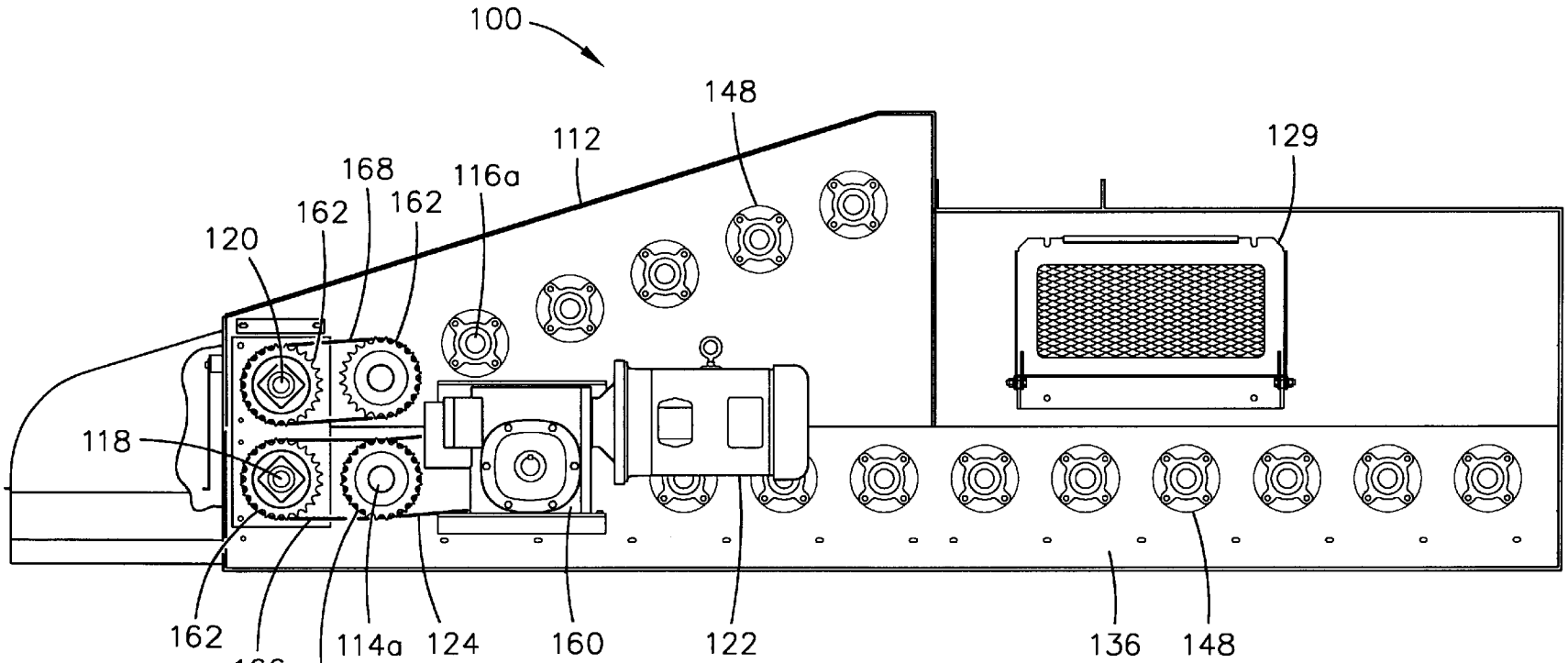
FIG. 8 is a second side elevation view of the machine on FIG. 6.

Referring now to FIGS. 8 and 9, the motor 122 is positioned on the side 136 of the frame 112 and is attached to a motor housing 160. The motor housing 160 is mounted to the frame 112 and provides support for the motor 122. Drive sprockets 162 are attached to the rotatable crushing members 118 and 120 and to the first rotatable shaft 114*a* and second rotatable shaft 116*a* located closest to the rotatable crushing members 118 and 120, on side 136. A drive chain 166 attaches between the drive sprocket 162 on crushing member 118 and the drive sprocket 162 on the first rotatable shaft 114*a*. A drive chain 168 attaches between the drive sprocket 162 on rotatable crushing element 120 and the drive sprocket 162 on the second rotatable shaft 116*a*. The end of shaft 114*a* has an additional drive sprocket 164, on side 136, attached by a drive chain 124 to a drive sprocket in the motor housing 160.

Referring again to FIGS. 5 and 6, a plurality of rotation sprockets 163 are attached to the end of each of the first rotatable shafts 114 and the second rotatable shafts 116, on side 134. A drive chain 140 interconnects the rotation sprockets 163 of the first rotatable shafts 114, while a drive chain 142 interconnects the rotation sprockets 163 of the second rotatable shafts 116. Safety covers 144 and 146 on side 134 cover the rotation sprockets 163 and drive chains 140 and 142. On side 136, end covers 148 cover the ends of the shafts 114 and 116. Intermeshing gears 150 are attached to the end of the rotatable crushing members 118 and 120, on the side 136 such that when one rotatable crushing member rotates, the other rotatable crushing member rotates in an opposite direction.

The motor 122 drives a drive sprocket in the motor housing 160 turning the drive chain 124 and drive sprocket 164, thereby rotating the first shaft 114*a* in a first direction. Since all of the first rotatable shafts 14 are interconnected by rotation sprockets 163 and drive chain 140, all the first shafts 114 rotate together in the first direction with the same speed. In addition, the drive sprocket 162 of first shaft 114*a* is connected by drive chain 166 to the drive sprocket 162 of the rotatable crushing member 118, rotating it in the first direction. The intermeshing gear 150 on the rotatable crushing member 118 engages with the intermeshing gear 150 on the rotatable crushing member 120, rotating it in a second direction. The drive sprocket 162 of the rotatable crushing member 120 is connected by the drive chain 168 to the drive sprocket 162 of the second shaft 116*a*, rotating it in the second direction. Since all of the second rotatable shafts 116 are interconnected by rotation sprocket 163 and drive chain 142 on the side 134 all the second rotatable shafts 16 rotate together in the second direction with the same speed. The rotating second direction of the second rotatable shafts 116 being opposite to the rotating first direction of first rotatable shafts 114. The motor may be stationed at positions other than those shown, both on and off the frame 112 as design and installation considerations dictate. The size of the motor is dependent on a number of factors such as type of containers to be crushed, number of rollers, type of drive mechanism and so on. For example, the motor size may have a rating of around 6 HP.

As shown in FIG. 5, the containers 130 are introduced into the machine 100 through the input opening 126 in the top of frame 112. The input hopper 127 may also be used to funnel the containers 130 into the input opening 126. Although the input hopper is directly on top of the frame 112 near its front end, this is not intended to so limit the introduction of containers into the frame 112. Indeed, if design or installation considerations dictate, an input hopper may be provided on the front end or sides of the frame 112. The containers 130 may also be input through access doors 129 in the sides and front of the frame 112.

Once the containers 130 are input into the frame 112, they are conveyed in a screen fashion on top of the perforating elements 152 of the first rotatable shafts 114 toward the discharge opening 128 of the frame 112. The first shafts 114 are rotated by the motor 122 to transport the containers 130 from the front to the back of the frame, as described above. Due to the angled intersecting plane in which the plurality of second shafts 116 lie, as the containers 130 approach the rear of the frame 112, they become engaged with the perforating elements 152 of the second rotatable shafts 116. The second rotatable shafts 116 are rotating in a opposite direction from the first rotatable shafts 114, moving the containers 130 from the wide end of the wedge described by the first rotatable shaft 114 and the second rotatable shafts 116, to its narrow end. Because of the converging planes and rotation of the first rotatable shafts 114 and the second rotatable shafts 116, the containers 130 start to become compressed between the first rotatable shafts 114 and the second rotatable shafts 116 as they travel from front to back toward the crushing elements 118 and 120. As the compression starts, the spikes 154 of the perforating elements 152 poke holes 131 in the containers 130, relieving them of any pressure or contents that may be inside. Due to the perforating of the containers 130 by the spikes 154, it is unnecessary to remove any caps or to fully empty the containers 130. The now empty containers 130 with holes 131 are then introduced between the crushing members 118 and 120 are then further crushed into crushed containers 132. Because of the holes 131, there is no danger of explosion of the containers 30 due to compression while being crushed. The crushed containers 132 are then discharged through the discharge opening 128 near the end of the frame 112. Optionally, the discharge opening 128 may discharge the crushed containers 132 onto a conveyer belt, into a basket, or other suitable means of carrying the crushed containers away from the machine 100 to be further processed.

While the invention herein disclosed has been described by means of specific embodiments and applications thereof, numerous modifications and variations could be made thereto by those skilled in the art without departing from the scope of the invention set forth in the claims.

I claim:

1. A machine for perforating and crushing containers, comprising:

a frame having a first end and a second end, and first and second portions;

a container input opening in the frame;

a container discharge opening in the frame;

a first plurality of shafts rotatably mounted in the first portion in a first plane;

a second plurality of shafts rotatably mounted in the second portion in a second plane, the second plane angled with respect to the first plane and intersecting the first plane near the second end of the frame;

a plurality of perforating elements on shafts of the first and second pluralities of shafts;

a first drive mechanism coupled to the first plurality of shafts; and a second drive mechanism coupled to the second plurality of shafts.

2. The machine of claim 1, wherein the second portion is pivotable with respect to the first portion.

3. The machine of claim 2, further including a support frame positioned near the second end of the frame; and a pulley mounted in the support frame and attached to the second portion near the second end.

4. The machine of claim 1, further including a first motor coupled to the first drive mechanism; and a second motor coupled to the second drive mechanism.

5. The machine of claim 4 wherein the first motor coupled to the first drive mechanism causes the first plurality of shafts to rotate in a first direction; and the second motor coupled to the second drive mechanism drive mechanism causes the second plurality of shafts to rotate in a second direction, the second direction being opposite the first direction, whereby a container entering the input opening between the first and second plurality of shafts is perforated by the perforating elements and crushed between the first plurality of shafts and the second plurality of shafts, the crushed containers exiting through the discharge opening.

6. The machine of claim 1 wherein each perforating element includes a plurality of spikes.

7. The machine of claim 1, further including:

a first rotatable crushing member and a second rotatable crushing member rotatably mounted in the frame near the intersection of the first and second planes.

8. The machine of claim 7 wherein the first and second rotatable crushing members each includes a plurality of cooperating bumps and a plurality of slots for receiving portions of the perforating elements from adjacent shafts.

9. The machine of claim 7, further including a motor coupled to the first and second crushing members and to the first and second drive mechanisms for rotating the crushing members and the first and second pluralities of shafts.

10. The machine of claim 9 wherein the first drive mechanism includes a first drive means for rotating the first plurality of shafts and the first crushing member in a first direction and the second drive mechanism includes a second drive means for rotating the second plurality of shafts and the second crushing member in a second direction, the second direction being opposite to the first direction, whereby a container entering between the first and second plurality of shafts is perforated by the perforating elements, compressed between the first and second plurality of shafts, crushed between the crushing members, and the crushed containers exiting through the discharge opening.

11. The machine of claim 1 wherein the input opening is located near the first end and the discharge opening is located near the second end.

12. The machine of claim 11 wherein the input opening is generally above the first plurality of shafts and the discharge area being generally at the intersection of the first and second planes near the second end.

13. The machine of claim 1 wherein the first plane is a horizontal plane.

14. The machine of claim 1 wherein the angle between the first plane and second plane is between 0 and 80 degrees.

15. The machine of claim 1 wherein the number of shafts in the first plurality of shafts is greater than the number of shafts in the second plurality of shafts.

16. The machine of claim 1 wherein the shafts are made of steel.

17. A machine for perforating and crushing containers comprising:

a frame having a first end, a second end, first side and second side, and a rigid first portion and a pivotally mounted second portion;

a container input opening in the frame;

a container discharge opening in the frame;

a first plurality of shafts rotatably mounted in the first portion between the first and second sides in a first plane;

means for rotating the first plurality of shafts in a first direction;

a second plurality of shafts rotatably mounted in the second portion between the first and second sides in a second plane, the second plane angled with respect to the first plane and intersecting the first plane near the second end of the frame;

an opening between the first plane and second plane decreasing from the first end to the second end of the frame such that containers will fit between the first plurality of shafts and second plurality of shafts when introduced between them from the first end;

means for rotating the second plurality of shafts in a second direction, the second direction being opposite the first direction; and a plurality of perforating elements on shafts of the first and second plurality of shafts, the perforating elements being capable of perforating the container whereby the container being introduced through the input opening travels between the first and second plurality of shafts from the first end to the second end being perforated by each successive row of shafts thereby evacuating any air or fluids in the container, being flattened, and being discharged through the discharge opening.

18. The machine of claim 17, further including:

means for pivoting the first portion with respect the second portion.

19. The machine of claim 18 wherein the means for pivoting is a support frame positioned near the second end and a pulley mounted in the support frame and attached to the second portion.

20. The machine of claim 17 wherein the means for rotating the first plurality of shafts is a first motor couple to the first plurality of shafts for rotating them in the first direction and the means for rotating the second plurality of shafts is a second motor coupled to the second plurality of shafts for rotating them in the second direction.

21. A method for perforating and crushing containers in a frame having a first portion with a plurality of rotatably mounted first shafts with perforating elements, the first shafts being coupled to a first motor, a second portion with a plurality of rotatably mounted second shafts with perforating elements, the second shafts being coupled to a second motor, a container input and a container discharge opening, comprising;

rotating the first shafts with the first motor in a first direction;

rotating the second shafts with the second motor in a second direction;

inserting the container in the input opening near a first end of the frame, the container going between the first shafts disposed in a first plane and the second shafts disposed in a second plane, the second plane angled with respect to the first plane and intersecting the first plane near a second end of the frame, the container engaging the first shafts and the second shafts;

perforating the container with a plurality of spikes on the perforating elements during engagement of the container with the first shafts and the second shafts, allowing the contents of the container to escape; and flattening and crushing the containers; and, discharging the container through the discharge opening.

22. The method of claim 21, further comprising the step of:

crushing the container between first and second rotatable crushing members located at the intersection of the first plane and the second plane.

* * * * *